United States Patent [19]

Ciaffone

[11] 4,275,498

[45] Jun. 30, 1981

[54] SAFETY RAZOR BLADE CARTRIDGE

[75] Inventor: John T. Ciaffone, Bridgeport, Conn.

[73] Assignee: Warner-Lambert Company, Morris Plains, N.J.

[21] Appl. No.: 108,744

[22] Filed: Dec. 31, 1979

[51] Int. Cl.[3] ..... B26B 21/06; B26B 21/22; B26B 21/52

[52] U.S. Cl. ..... 30/47; 30/50; 30/89; 30/346.58

[58] Field of Search ..... 51/47, 50, 87, 89, 32, 51/346.58, 346.59

[56] References Cited

U.S. PATENT DOCUMENTS

| | | | |
|---|---|---|---|
| 1,460,139 | 6/1923 | Parker | 30/32 X |
| 1,742,330 | 1/1930 | Valet | 30/47 |
| 1,825,795 | 10/1931 | Heymann | 30/50 |
| 2,262,476 | 11/1941 | Sussman | 30/50 X |
| 3,078,569 | 2/1963 | Sidney | 30/32 |
| 3,660,893 | 5/1972 | Welsh | 30/50 |
| 3,738,000 | 6/1973 | Samko | 30/32 |
| 3,975,820 | 8/1976 | Torance | 30/50 |
| 4,063,357 | 12/1977 | Francis | 30/50 |
| 4,227,302 | 10/1980 | Torrance | 30/47 |

FOREIGN PATENT DOCUMENTS

| | | | |
|---|---|---|---|
| 468611 | 11/1928 | Fed. Rep. of Germany | 30/89 |

*Primary Examiner*—Gary L. Smith

*Attorney, Agent, or Firm*—S. A. Schneeberger; L. S. Gillow; R. S. Strickler

[57] ABSTRACT

A razor blade cartridge pivotally mounted in a razor has a sheet-like blade holder with a slot having upper and lower inner inclined walls to one or both of which a single or twin blades are respectively secured by adhesive. A second slot is provided on the leading side of the leading blade. In a second embodiment, a double edge blade has a second cutting edge extending past the back surface of the blade holder.

7 Claims, 5 Drawing Figures

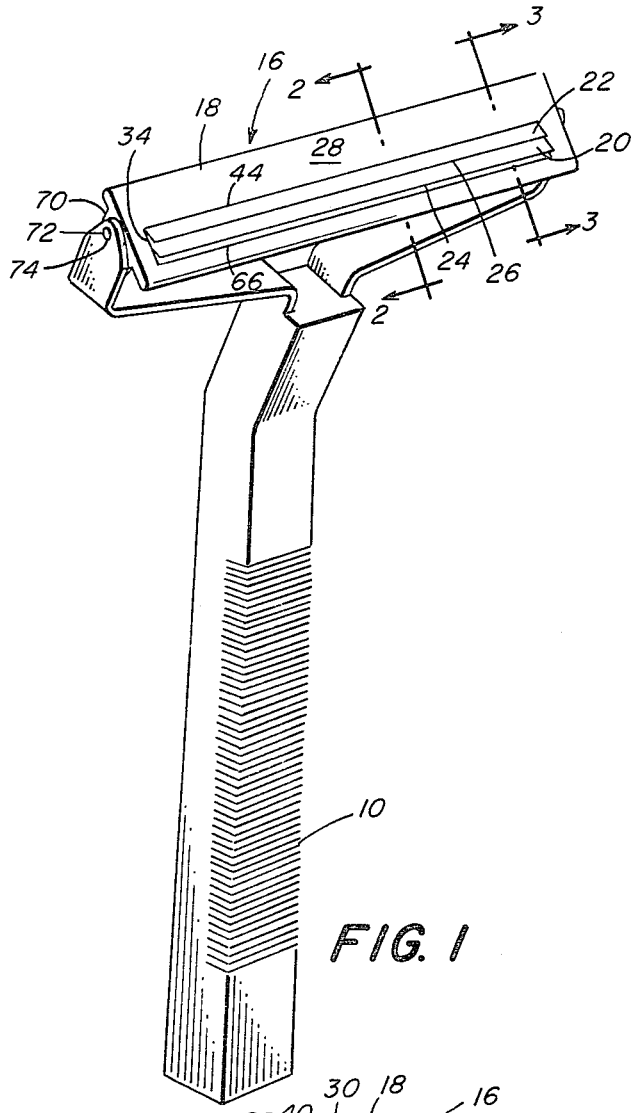
FIG. 1
FIG. 3
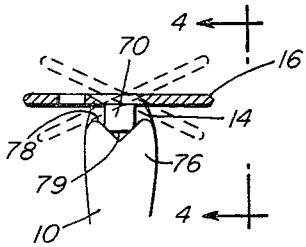
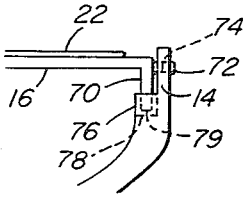
FIG. 4
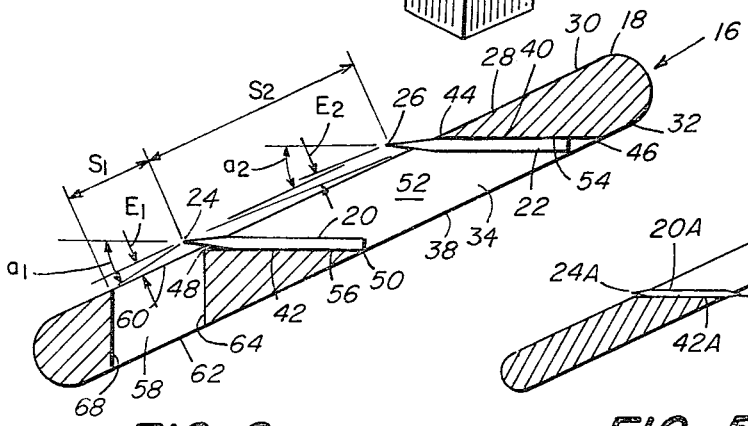
FIG. 2
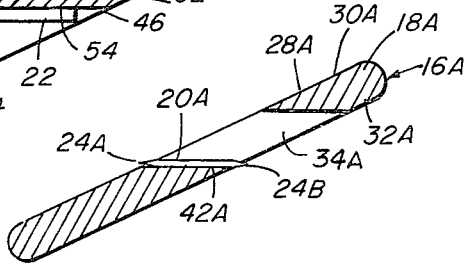
FIG. 5

SAFETY RAZOR BLADE CARTRIDGE

BACKGROUND OF THE INVENTION

This invention relates to safety razor wet shaving systems and particularly to blade cartridges for such systems.

One of the more significant changes in safety razor systems in recent years has been the increasing use of cartridges containing razor blades, rather than of razor blades alone, as the insertable and disposable unit for razors. The typical cartridge forms some elements of the blade holding assembly, often including the guard and cap for the blade. The blade is mounted in the cartridge by the manufacturer, allowing it to fix the geometric relationship between the blade and guard correctly, precisely, and permanently. This is an especially useful feature for those arrangements in which two spaced apart blades are secured in the cartridge with their cutting edges in parallel. The correct relation between the blades would be difficult to achieve if the blades themselves had to be inserted by the user.

Also, the cartridges provide a firm support for the blades. This allows the use of material for the blades that is thinner and narrower than when the blades themselves had to be handled by the user. Extremely narrow blades which cannot be safely handled by a user may be set into a cartridge by automatic machinery. Blades that are too thin to be handled by a user without damage to the blades may likewise be secured to supporting structure in a cartridge by automatic machinery. Once secured to supporting structure, the thin blades are as sturdy as thicker ones.

Some of the drawbacks of a blade cartridge are the additional manufacturing steps necessary to assemble a multipiece cartridge, and the problem the user has with cleaning the blade. There has always been a need to remove the debris collected on and around the blade edge during shaving. This need has become more acute as newer long-lasting blades have been developed in recent years. The amount of time in which debris can accumulate has increased as the time of use of the same blade has increased. The use of twin blade systems has also contributed to this need. The peripheral structure associated with a blade cartridge, however, often interferes with rinsing and cleaning a blade adequately. Sometimes this leads to the imposition of even more structure on the cartridge to aid in cleaning it.

Accordingly, it is a purpose of this invention to provide a new and more useful blade cartridge. Particular important objects are to provide a blade cartridge that is simple, easy and inexpensive to manufacture and that is lightweight and unobtrusive to use. It is another important object of the invention to provide a cartridge that minimizes the accumulation of debris about the blade edge and allows adequate flushing of any debris that does accumulate. Another object of the invention is to provide a cartridge that may be easily adapted for the manufacture of single blade as well as twin blade, and single edge as well as double edge, blade cartridges.

SUMMARY OF THE INVENTION

The razor blade cartridge of the invention includes a one-piece elongate sheet member for a blade having a longitudinal cutting edge and a given thickness. The sheet member includes a substantially planar elongate front shaving surface, a back surface substantially parallel to the front surface and a longitudinally extending slot with a width substantially larger than the thickness of the blade. The slot provides an opening in the sheet member's front surface communicating with an opening in the back surface. One elongate side of the slot is defined by an inner longitudinal wall inclined relative to the front surface, the wall having a front edge at the front surface, and a back edge at the back surface. The blade is secured to the wall with its cutting edge extending past the wall's front edge.

In one preferred embodiment of the invention, a second blade is secured to a second wall of the slot opposite the first wall, with its cutting edge extending past the second wall's front edge at the front surface of the sheet member. The blades' edges are substantially parallel and define leading and following cutting edges, and the sheet member has a second elongate slot parallel to the first one located just adjacent the leading blade edge on its leading side. The second slot, like the first, provides an opening in the front surface communicating with an opening in the back surface.

BRIEF DESCRIPTION OF THE DRAWINGS

Other objects, features and advantages will be apparent from the following description of preferred embodiments of the invention together with the attached drawings, in which:

FIG. 1 is a perspective view of a razor incorporating a blade cartridge according to the invention;

FIG. 2 is a detailed cross sectional view of the cartridge of FIG. 1, along the line 2—2 of FIG. 1;

FIG. 3 is a side view of the top portion of the razor and cartridge along the line 3—3 of FIG. 1, showing particularly the relation of the cartridge to the razor handle;

FIG. 4 is a back view of the top portion of the razor and cartridge of FIG. 3, as seen along the lines 4—4 of FIG. 3; and FIG. 5 is a cross sectional view, like that of FIG. 2, of another cartridge embodying the invention.

DESCRIPTION OF PREFERRED EMBODIMENTS

FIG. 1 shows a safety razor which includes a handle 10 with arms 12 extending outwardly and upwardly from its top, the arms terminating in tabs 14 pivotally supporting a twin blade razor blade cartridge 16 between them. The razor blade cartridge 16 includes a blade holder 18 holding spaced apart twin blades, a leading blade 20 and a following blade 22.

As shown in FIG. 2, both blades 20, 22 are thin, narrow blades, having a typical thickness in the range of 0.002–0.010 inch and a typical width of 0.040 inch or more. They are single edge blades, each having a longitudinal cutting edge 24, 26 respectively, on one side only. In the twin blade arrangement shown, which is a common one, the cutting edges are parallel, are on the same side of the holder 18, and are spaced apart.

The blade holder 18 is molded from plastic and has a central sheet-like portion 28. This portion of the holder 18 has a planar, elongate, front shaving surface 30 and a back surface 32 parallel to the front. The holder 18 further includes an elongate slot 34 extending almost the entire length of the holder. The slot 34 provides an opening 36 in the front surface 30 of the holder 18 communicating with an opening 38 in the back surface 32.

The long sides of the slot 34 are defined by an inner longitudinal upper wall 40 inclined relative to the holder front surface 30 and a parallel lower wall 42. The upper wall 40 has a front edge 44 where it meets the front shaving surface 30 of the holder 18, and a back edge 46 where it meets the back surface 32. The lower wall 42 has a corresponding front edge 48 and a back edge 50. The upper and lower walls, 40, 42 are separated by a distance substantially greater than the added widths of the blades 20, 22 so that there is a space 52 between the blades through which a flushing stream of water may be directed to wash away debris accumulated around the blades. For instance, the spacing between the facing surfaces of blades 20 and 22 may be in the range of 0.020–0.030 inch.

The leading blade 20 is secured to the lower wall 42 by suitable fastening means, such as an adhesive 54. Suitable adhesives are acrylics, rubbers, silicones and various other synthetics. Examples of adhesive products now available that have been found to be suitable are Minnesota Mining & Manufacturing 415,463 Acrylic, NPE 901 Synthetic Rubber, and Dennison Silicone Rubber. The blade 20 is so located on the wall 42 that its cutting edge 24 extends past the front shaving surface 30 of the holder 18. The following blade 22 is secured by an adhesive 56 to the upper wall 40 in the same way so that its cutting edge 26 also extends past the front shaving surface 30 of the blade holder 18.

A second slot 58 in the blade holder 18 parallel to the first slot 34 is located in the holder adjacent the leading blade 20 on the leading side of the blade. The second slot 58 provides an opening 60 in the front surface 30 communicating with an opening 62 in the back surface 64 for flushing cartridge debris. In the illustrative embodiment the front edge of the second slot's upper wall 64 coincides with the front edge 48 of the first slot's lower wall 42, to provide a space immediately preceding the leading blade 20.

The orientation and location of the blades 20, 22 in the blade holder 18 determine the shaving characteristics of the blade cartridge 16. Parameters that are traditionally used to describe blade geometry include span, blade tangent angle, and exposure. Span refers to the distance measured between the tip of a blade and the first preceding point on the support structure that engages the skin. The blade tangent angle is the angle between a line bisecting the included angle formed by the sides of the blade edge and the line extending from the blade edge to the first preceding skin engaging point. The exposure of a blade is defined as the perpendicular distance the cutting edge of a blade projects past a line drawn between the closest skin engaging points on either side of the blade.

In FIG. 2, $S_1$ refers to the span of the leading blade 20, and is the distance between the leading blade edge 24 and the front edge 66 of the second slot lower wall 68. The blade tangent angle for the leading blade 20 is designated $a_1$ in FIG. 2. $E_1$ designates the exposure for the leading blade 20. $S_2$ refers to the span for the following blade 22, and is the distance between the edge 26 of the following blade 22 and the edge 24 of the leading blade 20. The blade tangent angle for the following blade 22 is designated $a_2$. $E_2$ designates the exposure for the following blade 22.

As can be seen from an examination of FIG. 2, these parameters are functions of the width of the slots 34, 58, the orientation of the inclined walls 40, 42 of the first slot 34, and the location of the cutting edges 24, 26 of the blades 20, 22 relative to the holder front surface 30. Thus, the widths of the slots 34, 58 help determine the span for the blades 20, 22 in the cartridge. The extent of inclination of the walls 40, 42 of the first slot 34 help determine the blade tangent angle. The extension of the blade cutting edges 24, 26 past the blade holder front surface 30 help determine the exposure of the corresponding blades 20, 22. The configuration of the slots 34, 58 are selected to provide shaving characteristics for the cartridge that are desirable.

As shown in FIGS. 3 and 4, the razor blade cartridge 16 is mounted in the razor handle arm tabs 14 for pivotal movement. The cartridge 16 has pins 72 projecting outwardly from the ends thereof through holes 74 in the handle arm tabs 14. The pins 72 extend along a line which preferably is rearwardly of and below the edges of blades 20, 22 by only a very small distance. The cartridge 16 may pivot about the pins 72 within a range substantially delimited by the dotted line representations in FIG. 3. The cartridge 16 is urged to a neutral position intermediate the dotted extremes by means of any of a variety of suitable camming arrangements. Preferably such camming arrangement creates relatively little or no interference with the flow of rinse water between blades 20, 22. In the embodiment illustrated in FIGS. 3 and 4, the interior surface of the razor handle arm tabs 14 has a portion 76 projecting inwardly and having an upwardly facing cam surface 78 for camming engagement with a cam follower surface 79 defined by the lower surface of each of a pair of tabs 70 extending downwardly from the opposite ends of the cartridge 16. The pivot pins 72 may, in fact, extend outwardly from the sides of cartridge tabs 70.

The razor blade cartridge 16 is used for shaving in the conventional way. In a manner not illustrated or described, because not essential to an understanding of the invention, the cartridge 16 is inserted between the arms 12 of the razor handle 10. Then the razor may be used. Since the cartridge 16 is pivotable between the positions shown by the dotted representations in FIG. 3, it is free to follow the contours of the face or body portion being shaved without manipulation of the razor handle 10. After use of the razor, debris may be flushed from the cartridge 16 by running water through the slots 34, 58. Since the slots are unencumbered by interfering structure of any kind, and are substantially wider than the widths of the blades 20, 22, a large volume of water can be directed through the slots to flush debris.

FIG. 5 shows a second embodiment of the invention in a cross-sectional view like that of FIG. 2 for the first embodiment. A cartridge 16A includes a blade holder 18A with a central sheet-like portion 28A defining a front surface 30A and a parallel back surface 32A. Only one blade 20A is secured to an inclined wall 42A of a single slot 34A in the blade holder 18A of this second embodiment. The single blade 20A is, however, double-edged, having a front cutting edge 24A extending beyond the front surface 30A of the blade holder 18A, and a rear cutting edge 24B extending beyond the back surface 32A of the holder.

Both sides of the cartridge 16A shown in this embodiment may therefore be used. Some mechanism in the razor, not shown or described here because not essential to an understanding of the invention or within its scope, could be provided to allow the cartridge to be reversed. Or the cartridge could be removed from the razor, reversed, and be re-inserted.

As can be seen from the illustrative embodiments, the invention provides an extremely simple blade cartridge. A single blade holder with a properly located and sized slot having properly oriented walls provides all the support and orientation that blades for the cartridge need. The inclined plane of the inner walls of the slot provide the proper shaving angle as well as access to the walls for securing the blades. The wide, unencumbered, space that the slot provides allows rapid and easy flushing of debris that may have been captured. The existence of the wide space itself, moreover, minimizes the likelihood that much debris will accumulate.

Modifications of the disclosed embodiment are contemplated and would be within the scope of the invention. For example, the blade holder illustrated is made from plastic; it could be made from some other material such as metal. The blades illustrated are secured to the support by adhesive. They could be secured to the walls of the slot by mechanical fasteners or spotwelds, or any of a variety of fastening procedures. The cartridge pivot pins might instead be located on the handle and the pin-receiving holes located on the cartridge. Also, other camming arrangements might be provided for biasing the cartridge to a neutral position. For instance, the razor handle arms may be resiliently displaced laterally relative to one another such that an inwardly facing cam surface on the interior surface of the arm tabs will coact with a cam follower surface formed on the exterior surface of the cartridge tabs. Moreover, instead of pivotally mounting the cartridge or blade holder to the razor handle, it might be rigidly connected thereto as with well-known complementary dovetail coupling means associated with the cartridge and handle. Thus additions, subtractions, deletions and other modifications of the disclosed embodiments will be obvious to those skilled in the art and are within the scope of the following claims.

I claim:

1. A razor blade cartridge comprising:
a one-piece elongate member including
a front elongate shaving surface,
a back surface, and
a portion defining a longitudinally extending slot in said member comprising an opening in said front surface communicating with an opening in said back surface,
said portion including a longitudinal wall defining a side of said slot, that is inclined relative to said front surface, and
a blade secured to said wall having a longitudinal cutting edge extending past said member front surface,
said blade having a thickness less than the width of said slot.

2. A razor blade cartridge as claimed in claim 1 wherein said elongate member further includes blade pivotal connection means adapted to cooperate with razor pivotal connection means of a razor, whereby said cartridge may pivot during use of said cartridge in shaving.

3. A razor blade cartridge as claimed in claim 2 wherein said blade pivotal connection means includes a first member having a first camming surface adapted to cooperate with a second camming surface of a second member of said razor pivotal connection means.

4. A razor blade cartridge comprising:
a blade having a longitudinal cutting edge and a given thickness and
a one-piece elongate sheet member including
a substantially planar elongate front shaving surface,
a back surface substantially parallel to said front surface, and
a portion defining a longitudinally extending slot having a width substantially larger than said blade thickness comprising an opening in said front surface communicating with an opening in said back surface,
said portion including an inner longitudinal wall inclined relative to said front surface and defining an elongate side of said slot, said wall having a front edge at said front surface and a back edge at said back surface,
said blade being secured to said wall, with its cutting edge extending past said wall front edge.

5. The razor blade cartridge of claim 4 wherein:
said blade is a double-edged razor blade, having a second longitudinal cutting edge opposite said cutting edge, and said second cutting edge extends past said wall back edge.

6. The razor blade cartridge of claim 4 further including a second blade having a longitudinal cutting edge,
said portion including a second inner longitudinal wall opposite said first wall and substantially parallel to said first wall, having a front edge at said front surface and a back edge at said back surface,
said second blade being secured to said second wall with its cutting edge extending past said second wall front edge.

7. The razor blade cartridge of claim 6 wherein said blades are substantially parallel and define leading and following cutting edges,
said member further having a second portion defining a second elongate slot parallel to said first elongate slot comprising an opening in said front surface communicating with an opening in said back surface, said second slot front surface opening located adjacent said leading edge on the leading side.

* * * * *